US005718065A

United States Patent [19]

Löcker

[11] Patent Number: 5,718,065

[45] Date of Patent: Feb. 17, 1998

[54] SKI BOOT

[75] Inventor: Josef Löcker, Voitsberg, Austria

[73] Assignee: Atomic Austria GmbH, Austria

[21] Appl. No.: 624,503

[22] PCT Filed: Oct. 28, 1994

[86] PCT No.: PCT/AT94/00161

§ 371 Date: Apr. 5, 1996

§ 102(e) Date: Apr. 5, 1996

[87] PCT Pub. No.: WO95/11602

PCT Pub. Date: May 4, 1995

[30] Foreign Application Priority Data

Oct. 28, 1993 [AT] Austria ..... 2178/93

[51] Int. Cl.[6] ..... A43B 5/04

[52] U.S. Cl. ..... 36/117.1; 36/50.5

[58] Field of Search ..... 36/117.1, 118.2, 36/118.8, 118.9, 50.5, 54

[56] References Cited

U.S. PATENT DOCUMENTS

| | | | |
|---|---|---|---|
| 4,759,137 | 7/1988 | Lederer | 36/118.8 |
| 5,020,248 | 6/1991 | Hercog et al. | 36/117.8 |
| 5,243,774 | 9/1993 | Mattiuzzo . | |
| 5,592,758 | 1/1997 | Iwama et al. | 36/117.1 |

FOREIGN PATENT DOCUMENTS

| | | | |
|---|---|---|---|
| 370 296 | 3/1983 | Austria . | |
| 0 479 123 A1 | 4/1992 | European Pat. Off. . | |
| 0 484 845 A2 | 5/1992 | European Pat. Off. . | |
| 0 551 881 A1 | 7/1993 | European Pat. Off. . | |
| 979790 | 4/1950 | France | 36/50.5 |
| 813960 | 7/1951 | Germany | 36/50.5 |

*Primary Examiner*—Paul T. Sewell
*Assistant Examiner*—Anthony Stashick
*Attorney, Agent, or Firm*—Nixon & Vanderhye P.C.

[57] ABSTRACT

A ski boot has a shell (1) and a shaft or a cuff (8). The shell contains two overlapping closing quarters bridged by a tongue-shaped instep cover (4). The closing members (3) engage the shell (1) through outer closing quarters (2) and thus close the inner overlapping closing quarters.

10 Claims, 5 Drawing Sheets

SKI BOOT

TECHANICAL FIELD

The invention relates to a ski boot comprising a shell, a shaft and closing flaps extending over the instep region and overlapping each other, which closing flaps are maintained in the closed position by closing elements, such as, e.g., buckles capable of being opened.

BACKGROUND

With ski boots of the initially defined kind which are also termed "overlap boots", insertion of the foot is effected via a widenable shaft. Contrary to types of boots termed as "rear-entry boots" and which allow for an insertion of the foot into a shell that in most cases is peripherally closed in the region of the instep after a rear flap has been tilted away, in such boots with central insertion of the foot, which are designed as overlap boots, closure in the instep region is only feasible by mutually bracing the closing flaps. While with designs having a peripherally closed instep region an adaptation to the shape of the foot is possible to a limited extent only, overlap boots mostly offer a better adaptability to the foot in the instep region. Due to the relatively high rigidity of the shell materials for ski boots, however, in such an overlap boot, in which the instep region is to be closed by mutual bracing of closing flaps, insertion of the foot is comparatively difficult, because the relatively rigid closing flaps can be widened only with great strength, particularly if the outdoor temperatures are low. Analogous considerations hold for the shaft region, which, for a central insertion of the foot also must be widenable to a great extent so as to guarantee for a simple insertion of the foot, with little strength required.

SUMMARY OF THE INVENTION

The invention now aims at further developing a boot of the initially defined kind such that insertion of the foot into the boot will be enabled with little strength required, while providing for a high adaptability of the shell to the shape of the foot, and at the same time improving closure and comfort of the boot. To solve this problem, the object according to the invention substantially resides in that the closing flaps are passed over by a tongue-shaped instep cover and are connected with further closing flaps externally of the projection of said instep cover onto said closing flaps, and in that the further closing flaps include the bearing places for the closing elements. By the fact that a tongue-shaped instep cover is provided additionally to the closing flaps and that the closing flaps are connected with further closing flaps, which themselves in turn carry the closing elements, a configuration is made possible in which the shell is substantially thinner walled in the instep region as compared to known constructions, and thus can be designed to be substantially more flexible. Such a thin-walled and flexible shell can be adapted to the shape of the foot in a substantially better and simpler manner, and by the fact that further closing flaps are connected to the relatively thin-walled and highly flexible closing flaps, the actual closing elements exert their tension on the inner closing flaps without causing punctual pressure spots. The external closing flaps thus attain the closing forces acting in the peripheral direction, as is the case in conventional overlap boots, which peripheral closing forces result in an exact and better adaptation of the closing flaps to the shape of the foot, and by the fact that a tongue-shaped instep cover is arranged between the closing elements externally passing thereover and the thin-walled and highly flexible end regions of the overlapping closing flaps, also here the reaction forces of the closing elements which would act as pressure forces in the middle region of the instep are distributed over a wide area, whereby pressure spots are avoided. On the whole, this tongue-shaped instep cover and the closing elements acting on the external closing flaps allow for the tilting down of the tongue when the closing elements have been opened, whereby only slight expansion forces are required to deform the thin-walled and highly flexible closing flaps for an insertion of the foot, thus substantially improving insertion of a foot inso such a boot, while simultaneously enabling a more exact adaptation of the fit to the respective shape of the foot due to the flexible and thin-walled configuration of the closing flaps.

For a better positioning and possibly an adjustment of the tongue-shaped instep cover, advantageously the design is chosen such that the further closing flaps at least partially extend over the instep cover, whereby simultaneously excessive pressure loads caused by the closing elements acting on the tongue-shaped cover are prevented. In any event, for a better introduction of forces and for maintaining the desired high flexibility and slight widening force, the design is made such that the further closing flaps as well as the instep cover have a wall thickness greater than the wall thickness of the inwardly arranged closing flaps, whereby it is ensured that also high closing forces can be exerted without excessively stressing the thin-walled and flexible material of the closing flaps.

To ensure a safe tilting away of the tongue-shaped cover, when the closing elements have been opened, and to ensure facilitating insertion of the foot, advantageously the design is chosen such that the instep cover is connected with the shell at a position in front of the overlapping region of the inwardly arranged closing flaps, wherein preferably the instep cover is designed as a sealing element at its end connected with the shell. In this manner, safe sealing is also attained at the critical position at which sealing problems traditionally are likely to occur in overlap boots, the sealing element extending over the abutment edge of the overlapping closing flaps of the shell, thus effecting safe sealing.

To further facilitate insertion of the foot into such an overlap boot, advantageously the design is made such that the shaft of the shell comprises in both, the region of the shin bone as well as the region of the calf bone, at least one respective incision extending substantially vertically to the sole, capable of being sealingly covered by the instep cover or by a pivotable heel flap, respectively. In this manner, a respective expandability of the shaft is ensured, wherein such an expandable shaft may be pivotably hinged in conventional manner, while at the same time a secure fit and a clear limitation of the pivot angle, in particular a defined limitation of the forward and rearward positions, can be realized in a simple manner. For this purpose, advantageously the design is made such that the shaft comprising the vertical incisions is connected with the shell so as to be pivotable towards abutments to a limited extent.

As already mentioned, the tongue-shaped instep cover is pivotably connected with the shell to allow for an easy insertion of the foot, wherein advantageously the design is made such that the instep cover is connected with the shell so as to be pivotable about an axis substantially parallel to the sole and about an axis crossing the sole. Such an instep cover ensures the required rigidity and stability, while on the whole the shell is very flexible and comfortable to wear, it being possible to change the characteristics of the boot by choosing various materials and wall thicknesses of the instep cover.

To ensure the respective good fit also in the region of the Achilles tendon and in the region of the shaft, despite the high flexibility of the shell, the heel or rear flap already mentioned before is provided, the design advantageously being made such that the heel flap, which can be tilted away, is fastened to the shell so as to be pivotable about the pivot axis of the shaft. Such a heel flap allows for the provision of a so-called "walking-standing mechanism" in a particularly simple manner, the design advantageously being made such that the heel flap which can be tilted away is pivotable into a first walking or standing position against adjustable delimiting abutments or adjustable tensioning elements, and after release of the tensioning element or unlocking of the abutment is tiltable into a foot insertion position.

The invention shall now be described in more detail and with reference to an exemplary embodiment schematically illustrated in the drawings.

DETAILED DESCRIPTION OF THE DRAWINGS

Figure 1:
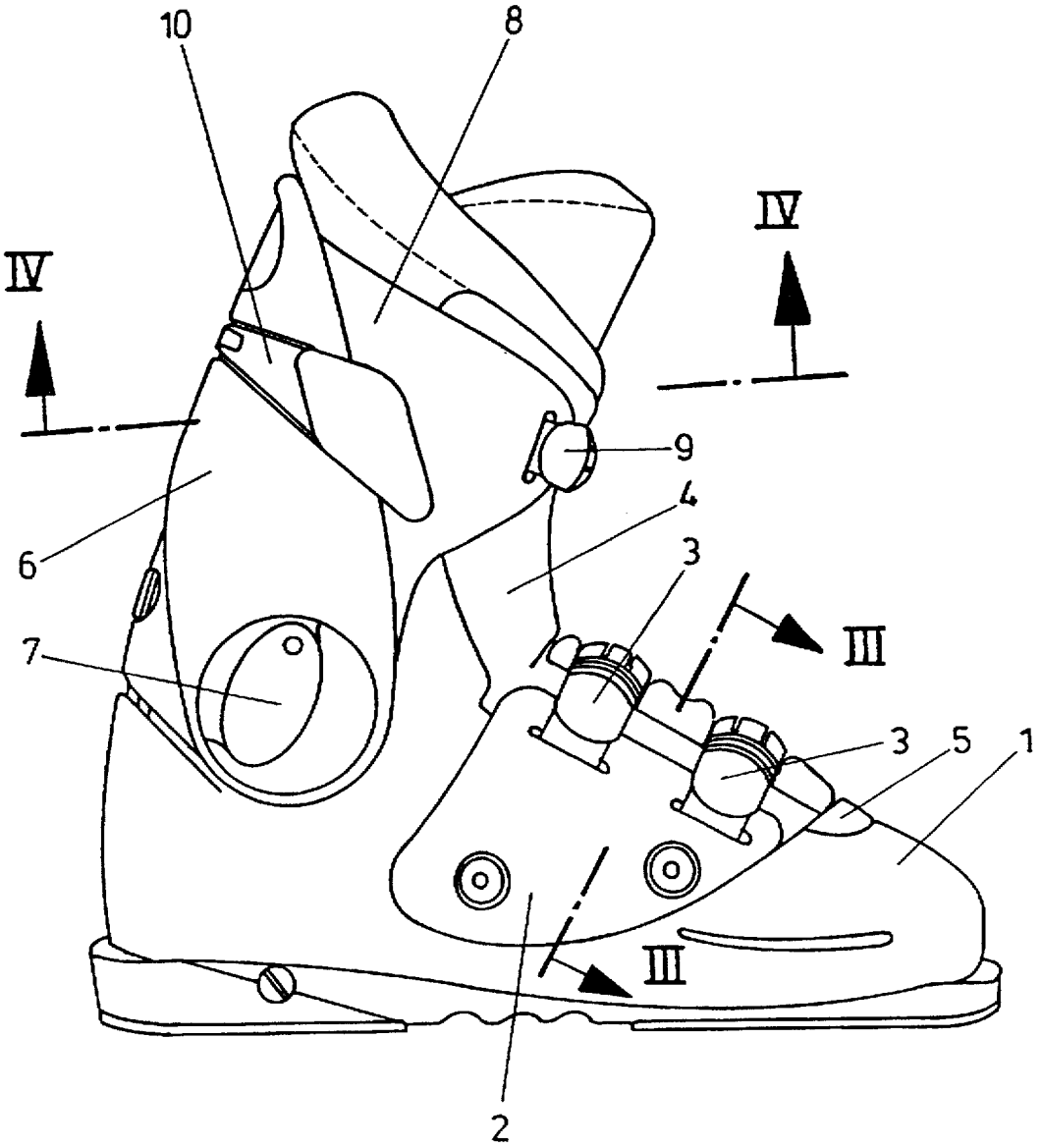
FIG. 1 shows a side view of the ski boot according to the invention.

In FIG. 1, the shell of a ski boot is denoted by 1, and outer closing flaps 2 fixed to the outer side of this shell can be seen which can be braced with each other via tensioning elements 3. The outer closing flaps 2 and the tensioning elements in the form of buckles 3 in this case extend over a tongue-shaped instep cover (or tongue) 4 which is connected to the shell 1 in region 5. Furthermore, a rear or heel flap 6 is pivotably hinged to shell 1, the pivot axis being indicated at 7. A shaft portion 8 is also pivotable about the same pivot axis 7, which shaft portion can be closed via a buckle 9 in the portion facing the instep. Thus, the shaft practically constitutes a type of cuff, the required rigidity being ensured by the rear flap 6 in the closing position, which rear flap in turn is maintained in this closing position by a tensioning element 10.

Figure 2:
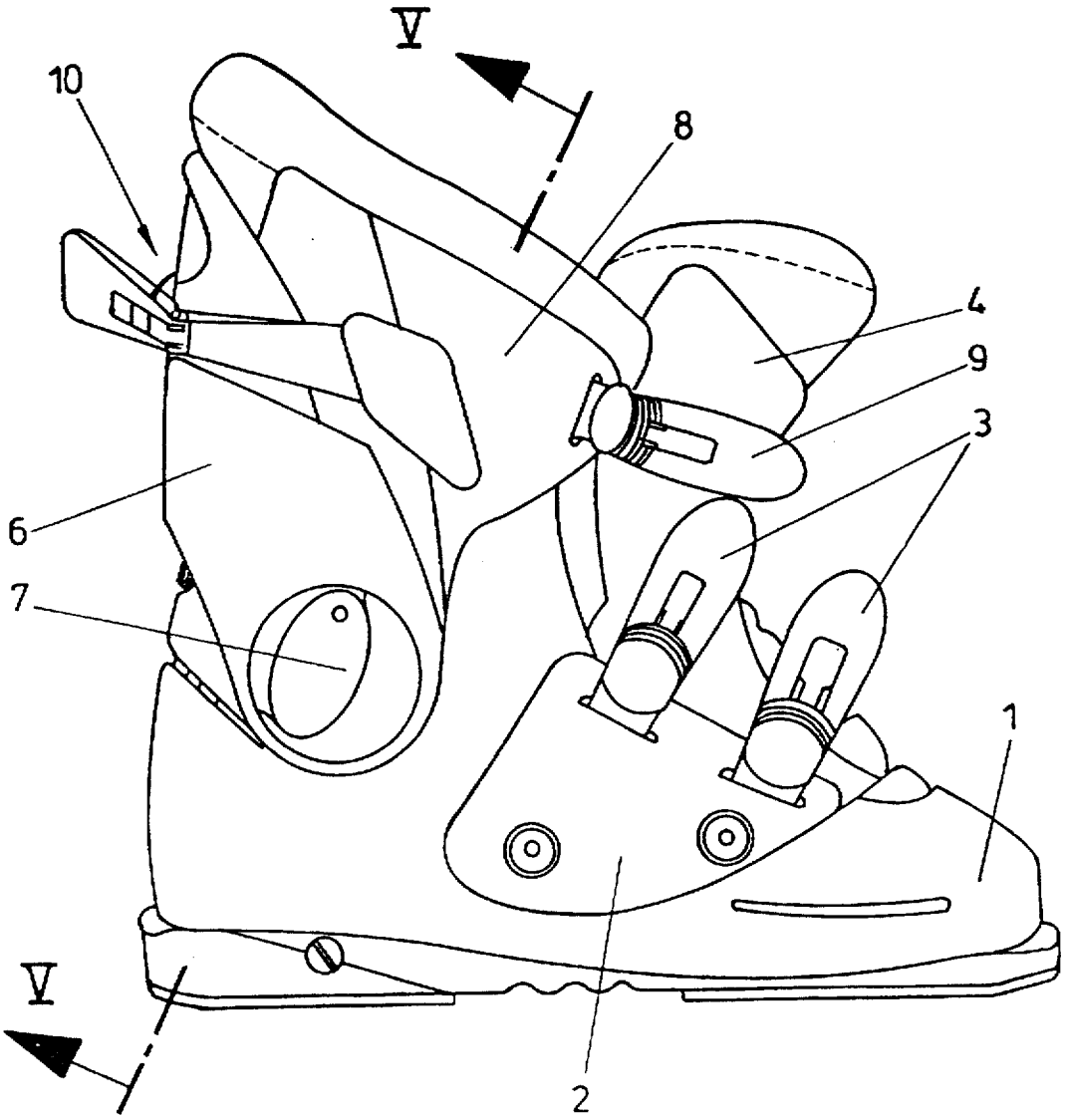
FIG. 2 shows a view according to FIG. 1, with the boot opened.
Figure 3:
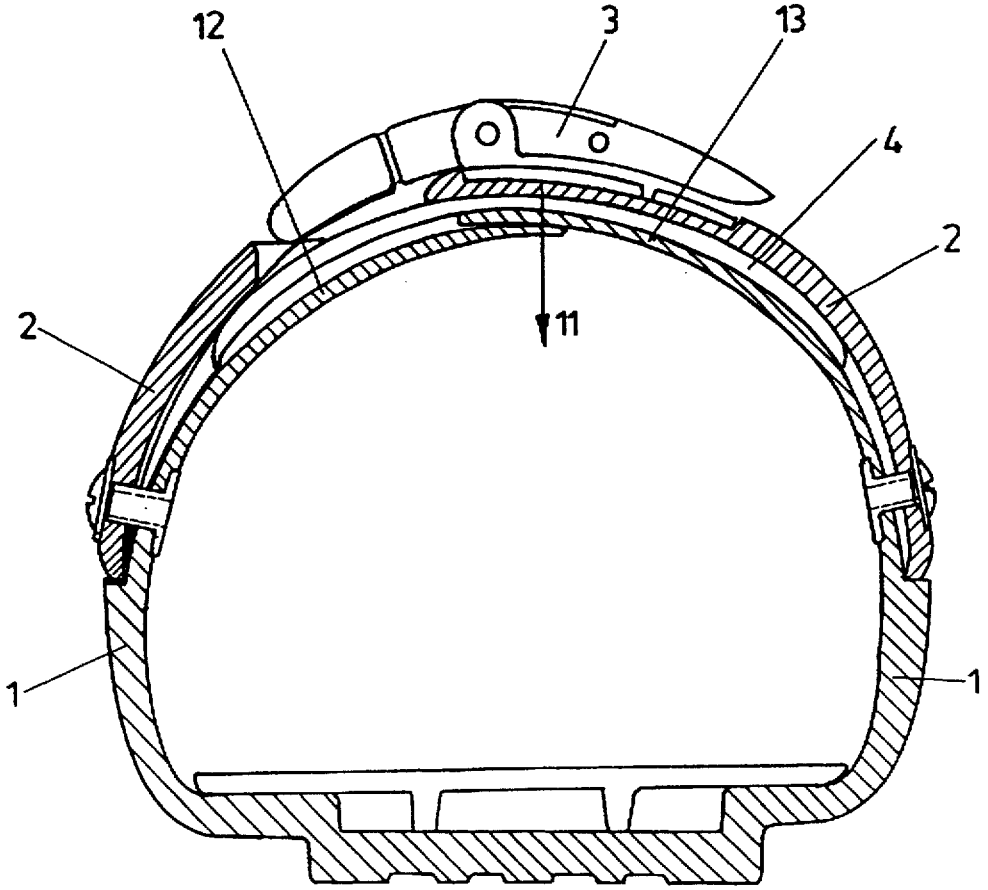
FIG. 3 shows a section according to line III/III of FIG. 1.

In the illustration according to FIG. 2, the tensioning element 10 is open, and the rear flap 6 has been rearwardly pivoted about the pivot axis 7. Simultaneously the shaft, or the cuff 8, respectively, in its partial region facing the instep in which it is designed to be slit, is open, the buckle 9 being illustrated in the open position. Also the buckles 3 extending over the tongue 4 are illustrated in the open position and it can be seen that the tongue 4 is forwardly pivotable, thus resulting in an overall large and comfortable opening for insertion of the foot, as is clearly visible from the illustration according to FIG. 2. Since the tensioning elements 3 engage at the inwardly arranged closing flaps of the shell 1 via the closing flaps 2 defined at the outer side of the shell 1 and thus cause a closing of the shell in the region of the instep, this inner partial region of the shell 1 may be designed extremely thin-walled and, thus, highly flexible. The configuration of the closing flaps of the shell overlapping each other is clearly visible in the section according to FIG. 3. There, the instep region is illustrated in the closed position of the buckles 3, with the outwardly arranged closing flaps 2 which are connected with the thick-walled region of the shell 1 partially overlapping the tongue 4. Thus, the tongue 4 acts as a pressure distributing plate and prevents an excessive pressure stress in the direction of the arrow 11, as would be caused by the tensioning elements 3 in the middle region. At the same time, this tongue 4 which assumes the function of a pressure distributing plate allows for a particularly thin-walled design of the closing flaps 12 and 13 overlapping each other, whereby high flexibility and a particularly good fit are achieved. As is desirable with an overlap boot, only forces acting in the peripheral direction are introduced in such closing flaps 12 and 13, thus resulting in the particularly suitable adaptation in the sensitive instep region without causing an excessive pressure load. Simultaneously, the thin-walled and flexible configuration of the overlapping closing flaps 12 and 13 naturally also make this region more water-proof.

Figure 4:
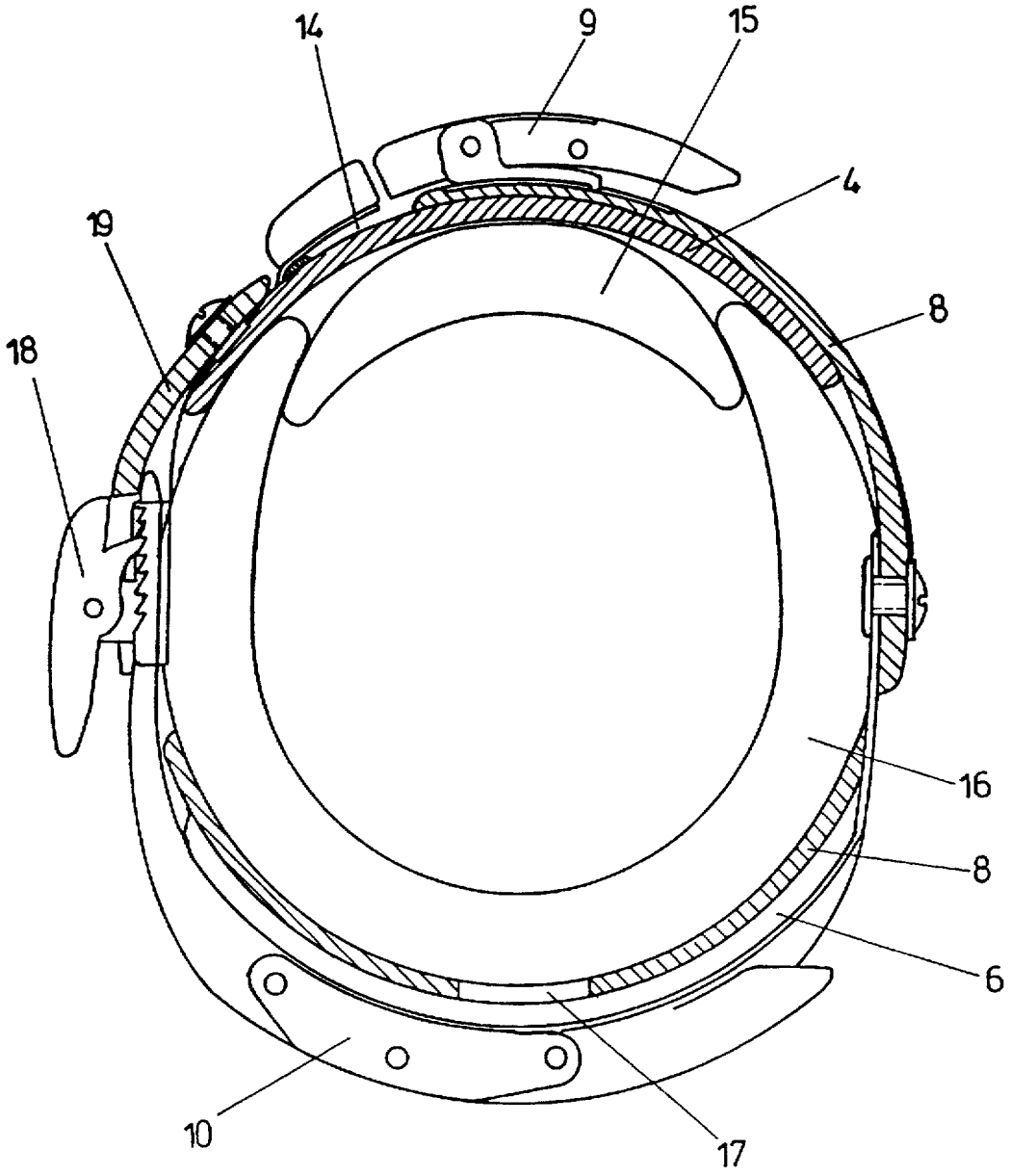
FIG. 4 shows a section according to line IV/IV of FIG. 1.

In the illustration according to FIG. 4, the details provided for a particularly wide opening of the shaft are clearly illustrated. In the section according to FIG. 4, the tongue 4 again is visible which is overlapped by the shaft or cuff 8, respectively, which is provided with a slit 14 in the instep region. The cuff 8 carries the closing element 9 which is illustrated in the closed position in FIG. 4. The padded tongue of the inner boot or inner lining is denoted by 15, while the padding of the inner boot in the shaft region is represented by 16.

The shaft 8 also has a slot 17 in the rear region around which a closing element 10 engages which cooperates with the rear flap 6. This closing element 10 is movable into a first open position which allows for the rear flap 6 to be tilted away and which may be brought out of engagement with the rear flap 6 by release of the closing element 18, thus enabling complete tilting away thereof. In this first position, thus, a walking position is achieved, whereas after complete release of the closing element 18 a complete tilting away of the rear flap 6 and thus a position for a particularly easy insertion of the foot may be assumed. The closing element 18 in turn is connected with a tensioning element 19 that cooperates with the closing element 9 of the cuff or shaft, respectively, and in this manner bridges the slit 14 in the front region of the cuff or shaft 8, respectively.

Figure 5:
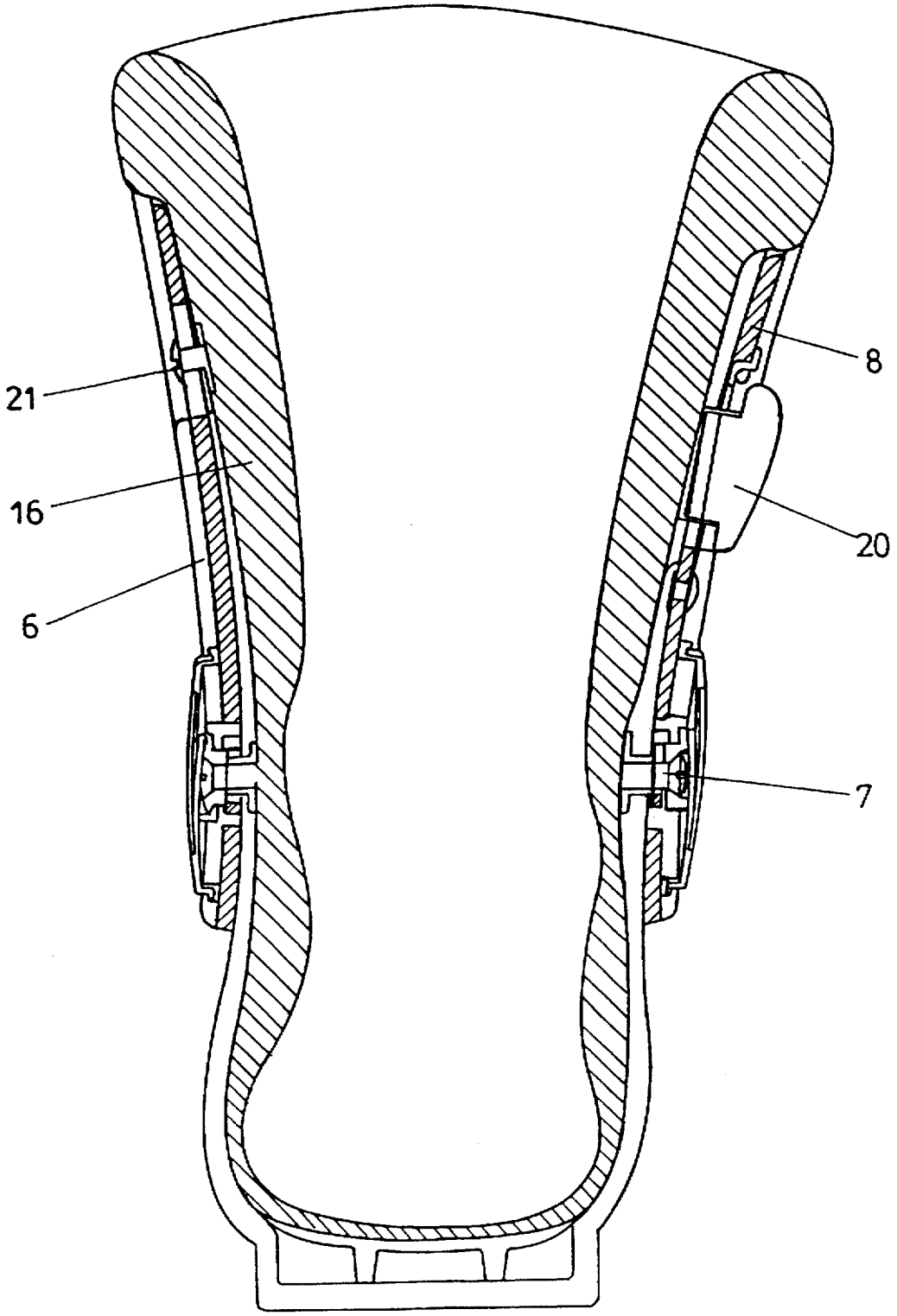
FIG. 5 shows a section according to line V/V of FIG. 2.

The pivotability of the shaft as well as of the cuff is more clearly visible in the illustration according to FIG. 5. In FIG. 5, the padding or inner boot 16, respectively, is again visible, the cuff or shaft 8, respectively, being hinged so as to be pivotable about the pivot axis 7. The site of enagement of the rear closing element 10 is denoted by 20, and the rear flap 6 is additionally pivotably hinged about the pivot axis 7. The pivot axis 7 may be conventionally designed as an eccentric so as to allow for a canting positioning. Anyway, the design includes screws to ensure easy assembly and simple disposal.

At 21 a region is illustrated in which the closing element 18 engages which is not illustrated in the illustration according to FIG. 5.

I claim:

1. A ski boot comprising a shell and a shaft which together define an instep region, said ski boot further comprising:

first closing flaps extending over the instep region and overlapping each other, said first closing flaps moveable between closed and open positions;

releasable buckle closing elements which maintain the first closing flaps in the closed position, and which have bearing places associated therewith;

a tongue-shaped instep cover which passes over the first closing flaps;

second closing flaps which are connected with the first closing flaps externally of the projection of said instep cover onto said first closing flaps; and wherein the second closing flaps include the bearing places for the buckle closing elements.

2. The ski boot according to claim 1 wherein the second closing flaps extend at least partially over the tongue-shaped instep cover.

3. The ski boot according to claim 1 wherein the second closing flaps and the instep cover have wall thickness dimensions greater than the wall thickness dimension of the first closing flaps.

4. The ski boot according to claim 1 wherein the tongue-shaped instep cover is connected to the shell at a site in from of an overlapping region of the first closing flaps.

5. The ski boot according to claim 1 wherein the tongue-shaped instep cover extends over the overlapping region of the first closing flaps, thereby acting as a sealing element at its end connected to the shell.

6. The ski boot according to claim 1 wherein the shaft of the shell comprises both, in the region of the shin bone as well as in the region of the calf bone, at least one respective incision extending substantially vertically and capable of being sealingly covered by the tongue-shaped instep cover or by a pivotable heel flap (6), respectively.

7. The ski boot according to claim 6 wherein the shaft is connected with the shell for pivotable movement relative to the shell.

8. The ski boot according to claim 1 wherein the tongue-shaped instep cover is connected with the shell (1) so as to be pivotable about a first axis substantially parallel to a sole of the boot and about a second axis crossing the sole.

9. The ski boot according to claim 6 wherein the pivotable heel flap is capable of being tilted away and is fastened to the shell so as to be pivotable about the pivot axis of the shaft (8).

10. The ski boot according to claim 1 wherein the pivotable heel flap is capable of being tilted away is pivotable into a first walking or standing position against adjustable delimiting abutments or adjustable tensioning elements, and after release of the tensioning element (10) or unlocking of the abutment can be tilted away into a foot insertion position.

* * * * *